United States Patent [19]

Sheem

[11] 4,166,618

[45] Sep. 4, 1979

[54] MISSILE LAUNCHING DEVICE COMBINED WITH TARGET

[76] Inventor: Sang K. Sheem, 7917 Spotswood Dr., Alexandria, Va. 22308

[21] Appl. No.: 823,412

[22] Filed: Aug. 10, 1977

[51] Int. Cl.[2] ..... A63B 67/18; F41J 3/00; A63B 65/00

[52] U.S. Cl. ..... 273/96 R; 124/23 R; 124/41 R; 273/106.5 A; 273/DIG. 30

[58] Field of Search ..... 124/23 R, 24 R, 41 B, 124/41 R; 273/DIG. 25, DIG. 30, 106.5 A, 96 R

[56] References Cited

U.S. PATENT DOCUMENTS

| | | | |
|---|---|---|---|
| 1,253,772 | 1/1918 | Bertucci | 273/106.5 A |
| 2,645,490 | 7/1953 | Volman | 124/41 B |
| 3,401,941 | 9/1968 | Hesidence | 273/DIG. 30 |
| 3,618,585 | 11/1971 | Allison | 124/41 R |
| 3,855,991 | 12/1974 | Imatt et al. | 273/106.5 A |
| 3,941,383 | 3/1976 | Clarke | 273/DIG. 30 |
| 3,953,030 | 4/1976 | Muchnick | 273/DIG. 30 |
| 3,954,266 | 5/1976 | Carrano et al. | 273/96 R |
| 4,017,076 | 4/1977 | Bai | 273/DIG. 30 |

FOREIGN PATENT DOCUMENTS

| | | | |
|---|---|---|---|
| 531250 | 8/1930 | Fed. Rep. of Germany | 124/23 R |
| 450584 | 11/1912 | France | 124/23 R |

*Primary Examiner*—Richard C. Pinkham
*Assistant Examiner*—Lawrence E. Anderson
*Attorney, Agent, or Firm*—Young & Thompson

[57] ABSTRACT

A recreational game toy for launching and catching projectiles or missiles comprising a target for projectiles or missiles and an acceleration element such as elastic band, spring, and bow-and-arrow wherein said target is incorporated with an attachment element, such as self-fastening textile materials (Velcro; Trade Name), to releasably hold projectiles or missiles to said target, and said target is connected to or engaged with said acceleration element.

1 Claim, 2 Drawing Figures

MISSILE LAUNCHING DEVICE COMBINED WITH TARGET

BACKGROUND AND SUMMARY OF THE INVENTION

It is not only pleasant but also good for health to play such recreational games as dart throwing, archery, badminton, and Frisbee(Trade Name). I disclose here an invention which would introduce a recreational game that would be as interesting and casual as dart throwing, as intense and masculine as archery, as safe and pleasant as badminton, and as friendly and joyous as Frisbee.

The invention disclosed here may well be embodied into a bow-and-arrow system, even though its embodiment is not limited to this particular form. In this particular embodiment, a target for missiles or projectiles, preferably of the round disk shape, is mounted on or fixed to the front end of an arrow. The rear end of the arrow is connected or tied to the string of a bow. The surface of the target is covered with some kind of attachment means, preferably with one part of two parts self-fastening textile materials such as Velcro(Trade Name). Then, a missile or projectile such as shuttle cock can releasably adhere to the target surface, mostly on impact in the real playing, if the head of missile is also covered with an adhesion means, such as Velcro hook material, matched to that of the target surface. In launching such a missile, the target and the missile are accelerated together by the usual mechanism of bow. When the acceleration force of the missile becomes greater than the adhering or gripping force between the missile and target, the missile is released from the target surface and is launched into the air.

The merits and the detailed features of my invention will be further clarified in the following description.

DESCRIPTION

Brief description of the drawings is as following:

Figure 1:
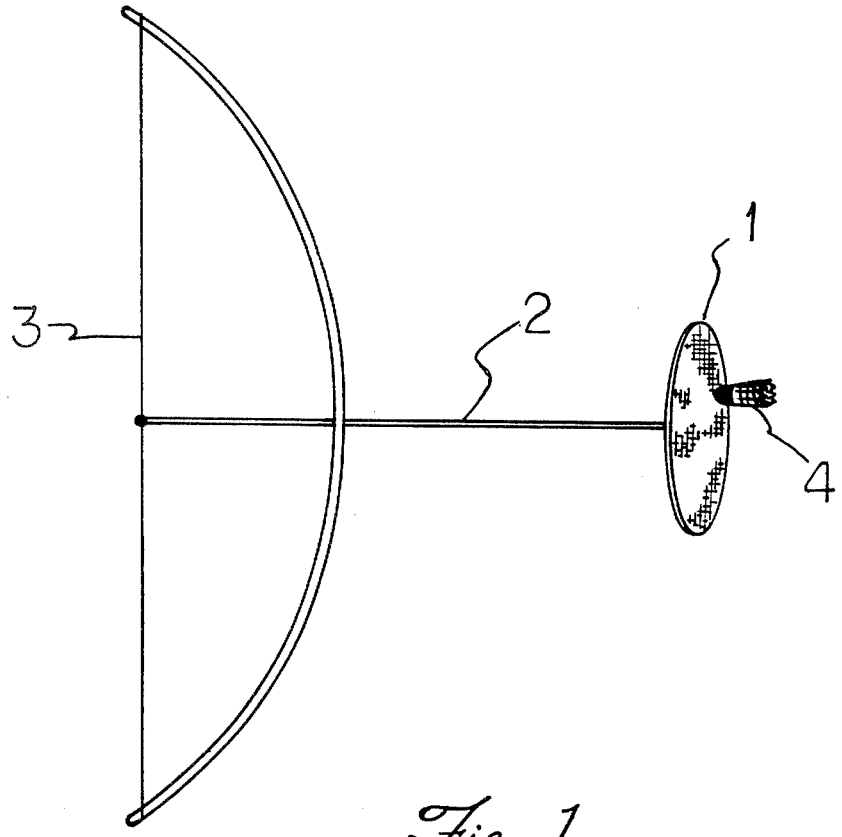
FIG. 1 shows a schematic diagram of one example of embodiment of the invention.

Now, referring to FIG. 1, a target 1 preferably in the shape of round disk is mounted on or attached to the front end of an arrow 2. The other end, that is, the rear end of arrow 2 is captured on or tied to bowstring 3. The surface of target 1 and a missile or projectile 4 are designed to releasably adhere together on impact or when they are in physical contact. This may be achieved by self-fastening or self-gripping textile materials such as Velcro, or simply utilizing magnetic force. One can also use a suction cup for the same purpose. In order to catch a missile such fabricated, one simply places the target 1 in the flight path of the missile 4. For the subsequent launching of the missile 4, one simply stretches the bowstring 3 and releases it. Since the arrow 2 is tied to the bowstring 3, it will not be launched into the air. However, the projectile or missile 4 can be released from the target 1 and launched into the air if the acceleration force of the missile 4 ($\vec{F}_a$ in FIG. 2) is greater than the adhering or gripping force between the missile 4 and the target 1 ($\vec{F}_g$ in FIG. 2). The difference between the two forces ($\vec{F}_d$ in FIG. 2) will then contribute toward the acceleration of the missile 4 in the air.

Figure 2:
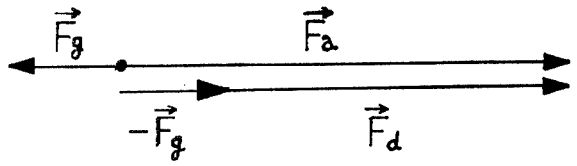
FIG. 2 represents a force vector diagram for the structure in FIG. 1. This force vector diagram, however, applies to every possible embodiment of my invention.

Even though the above physical description with the aid of FIG. 2 may have been somewhat simplified to explain the actual mechanism of my invention, which has been introduced above in terms of the embodiment in FIG. 1, experimental demonstrations have been successfully carried out with the schemes of FIG. 1 and few others. Apparently, it is quite possible to embody the catching and launching mechamism described above into various game and toy devices. All of these possible modifications and variations will be covered by the claims being set forth below.

What is claimed is:

1. A game toy for projectile launching and catching comprising a target having a substantially planar projectile landing and launching forward surface, an arrow secured to the center of the rear of the target for movement of the arrow and the entire target together as a unit, said surface being perpendicular to the arrow and extending a substantial distance in all directions perpendicular to the length of the arrow, a bow carrying a bow string, the end of the arrow opposite the target being connected to the bow string, one part of a two-part self-fastening textile material covering the whole of said forward surface of the target, and a projectile that carries the other part of said two-part self-fastening textile material, whereby the projectile can be caught and retained at any point on said surface of the target and, upon subsequently drawing and releasing the arrow, can be launched from that same point on the target at the end of the path of forward movement of the arrow and target relative to the bow.

* * * * *